United States Patent [19]

Schulz

[11] Patent Number: 4,892,043

[45] Date of Patent: Jan. 9, 1990

[54] SUBSIDIARY BENCH TOP

[76] Inventor: Richard H. Schulz, 845 N. L St., Livermore, Calif. 94550

[21] Appl. No.: 72,645

[22] Filed: Jul. 6, 1987

[51] Int. Cl.[4] ..... A47B 7/00

[52] U.S. Cl. ..... 108/90; 108/91

[58] Field of Search ..... 108/90, 97, 96, 98, 108/93, 91, 92, 53.1, 53.3, 53.5, 134, 157; 248/231.4, 231.5, 231.6, 238, 210; 297/153

[56] References Cited

U.S. PATENT DOCUMENTS

| | | | |
|---|---|---|---|
| 549,869 | 11/1895 | Dryfoos | 108/96 X |
| 803,916 | 11/1905 | Luppert | 108/91 |
| 1,058,300 | 4/1913 | Hall | 108/90 |
| 1,082,884 | 12/1913 | Leonard | 297/153 |
| 1,160,126 | 11/1915 | Baron | 108/96 |
| 1,352,810 | 9/1920 | Hunt | 248/231.6 X |
| 1,683,711 | 9/1928 | Burwell | 108/96 X |
| 2,368,991 | 2/1945 | Kopp | 248/231.4 X |
| 2,556,943 | 6/1951 | Reisman | 108/90 |
| 2,569,729 | 10/1951 | Nold | 108/97 X |
| 3,475,052 | 10/1969 | Kaposi | 297/153 |
| 3,659,297 | 5/1972 | Shutz | 108/90 X |
| 4,321,874 | 3/1982 | Cenna, III | 108/92 X |
| 4,373,756 | 2/1983 | Purdy et al. | 297/153 |

FOREIGN PATENT DOCUMENTS

| | | | |
|---|---|---|---|
| 1533224 | 7/1968 | France | 108/90 |

*Primary Examiner*—Kenneth J. Dorner
*Assistant Examiner*—José V. Chen
*Attorney, Agent, or Firm*—Burns, Doane, Swecker & Mathis

[57] ABSTRACT

A subsidiary bench top apparatus for a work bench or the like comprises a standing section secured to laterally extended brackets at opposing distal ends, four support members joined respectively to the brackets at one end and connected in pairs at the opposing distal end by medially disposed bolt and nut assemblies for fastening onto a work bench with lateral variation of the standing section respective of the work bench.

1 Claim, 1 Drawing Sheet

SUBSIDIARY BENCH TOP

BACKGROUND OF THE INVENTION

The need for an increase in the standing elevation of benches being used in drywall applicating has been increasing over the years due to the design of much of the modern housing. Whereas extension legs are available for some of the benches along with an additional stepping means, they are somewhat expensive and time consuming to employ. The present invention is quickly and easily adaptable to a work bench at a fraction of the cost and can be offered as an alternative or an addition to the existing equipment thereof.

SUMMARY OF THE INVENTION

The present invention generally comprises a subsidiary bench top apparatus that can quickly increase the elevation of a bench being used in drywall applicating and that is easily accessible to the user. The standing section is supported by four members divisionally joined to a pair of brackets secured to the standing section at opposing distal ends thereof. The opposing distal ends of the members joining each bracket exclusively are connected by a bolt and nut assembly for solidly fastening onto a work bench. The manner in which the standing section is joined to the brackets causes a lateral variation of the structures providing a longitudinally stepping means for reaching the elevation so provided.

THE DRAWING

DETAILED DESCRIPTION

The present invention generally comprises a subsidiary bench top apparatus adapted for use with a drywall work bench or similar structure for increasing elevation that is easily accessible to the user.

Figure 1:
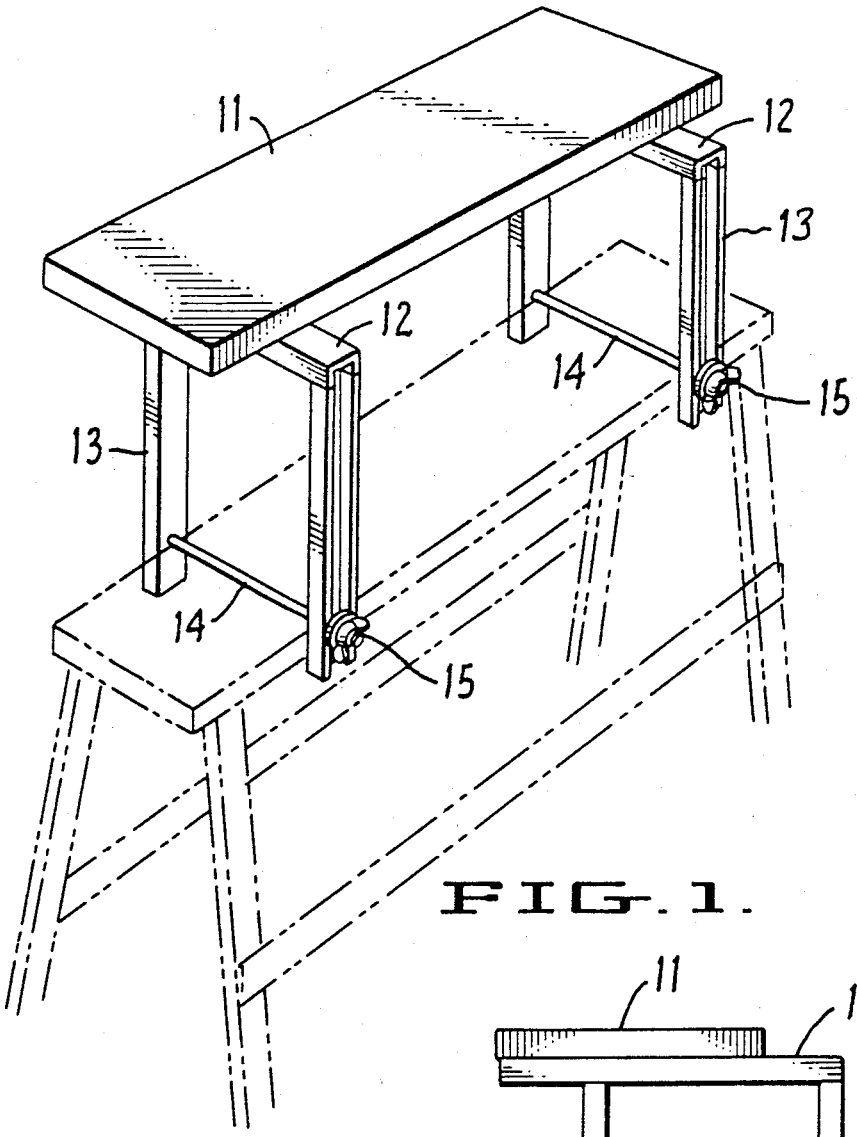
FIG. 1 is a perspective view of the present invention joined to a work bench.
Figure 2:
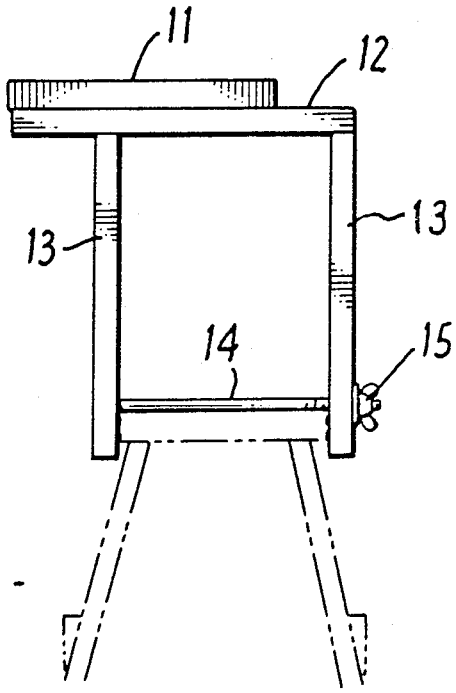
FIG. 2 is a side elevation of the present invention joined to a work bench.

As shown in FIGS. 1 and 2, the invention includes a standing section 11 with laterally extended brackets 12 joined to the standing section at each distal end of the standing section. Each of the brackets is joined to a pair of support members 13, respectively, that are in turn connected at the opposing distal end of the support members by a medially disposed bolt 14 and nut 15 for joining the invention to a work bench or the like. The bolt 14 rests upon the top of the work bench as can be seen in the figures. The pairs of support members 13 can be compressed to the work bench by the nut and bolt assemblies 14, 15. The standing section adds standing elevation to the work bench that is laterally and longitudinally accessible.

I claim:

1. A bench top extension for attachment to a work bench, said bench top extension comprising:

a standing section having longitudinal and lateral dimensions and having longitudinal and lateral ends;

a pair of brackets connected to said standing section near the longitudinal ends of the standing section, said brackets extending partially laterally away from said standing section;

two pairs of downwardly extending support members, each support member having a distal end, one pair of support members connected to each bracket with one support member at each end of each bracket; and a pair of nut and bolt assemblies interconnecting the distal ends of each pair of support members, each pair of support members and nut and bolt assemblies defining means to secure the bench top extension to a work bench, the bolts to rest on top of a work bench and the nut and bolt assemblies to laterally compress the distal ends of the support members against the sides of a work bench, said standing section being partially laterally offset with respect to a work bench to provide a stepping means from a work bench that is laterally accessible to increase the effective elevation of a work bench.

* * * * *